US011204007B2

(12) United States Patent
Ittlinger

(10) Patent No.: US 11,204,007 B2
(45) Date of Patent: Dec. 21, 2021

(54) VALVE FOR METERING A FLUID

(71) Applicant: Robert Bosch GmbH, Stuttgart (DE)

(72) Inventor: Ralph Ittlinger, Weissach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/385,159

(22) Filed: Dec. 20, 2016

(65) Prior Publication Data

US 2017/0175695 A1 Jun. 22, 2017

(30) Foreign Application Priority Data

Dec. 22, 2015 (DE) ..... 102015226452.1

(51) Int. Cl.

| | |
|---|---|
| ***F02M 61/14*** | (2006.01) |
| ***F02M 51/06*** | (2006.01) |
| ***F02M 61/16*** | (2006.01) |
| ***F02M 51/00*** | (2006.01) |

(52) U.S. Cl.

CPC ..... *F02M 61/14* (2013.01); *F02M 51/005* (2013.01); *F02M 51/06* (2013.01); *F02M 51/0625* (2013.01); *F02M 61/168* (2013.01); *F02M 2200/8015* (2013.01); *F02M 2200/8046* (2013.01); *F02M 2200/852* (2013.01)

(58) Field of Classification Search

CPC .. F02M 51/005; F02M 51/06; F02M 51/0625; F02M 61/14; F02M 61/168; F02M 2200/8015; F02M 2200/8046; F02M 2200/852; F02M 2200/853

See application file for complete search history.

(56) References Cited

U.S. PATENT DOCUMENTS

| | | | | | |
|---|---|---|---|---|---|
| 2,753,216 | A * | 7/1956 | Wirsching | F02M 61/14 | 239/289 |
| 4,395,988 | A * | 8/1983 | Knapp | F02M 51/005 | 123/469 |
| 4,502,632 | A * | 3/1985 | Hafner | F02M 51/005 | 239/125 |
| 4,894,900 | A * | 1/1990 | Rausfeisen | B25B 27/0035 | 29/256 |
| 4,944,486 | A * | 7/1990 | Babitzka | F02M 51/0614 | 239/585.4 |
| 5,681,062 | A * | 10/1997 | Fukao | F16L 21/08 | 285/340 |
| 5,769,328 | A * | 6/1998 | Zdyb | F02M 51/061 | 239/585.1 |
| 6,019,089 | A * | 2/2000 | Taylor | F02M 61/145 | 123/456 |

(Continued)

FOREIGN PATENT DOCUMENTS

| | | |
|---|---|---|
| CN | 101249329 A | 8/2008 |
| CN | 203019968 U | 6/2013 |
| DE | 19950761 | 4/2001 |

*Primary Examiner* — Kevin F Murphy
*Assistant Examiner* — Jonathan J Waddy
(74) *Attorney, Agent, or Firm* — Norton Rose Fulbright US LLP; Gerard Messina

(57) ABSTRACT

A valve is used to meter a fluid. The valve can be fashioned in particular as a fuel injection valve for internal combustion engines. The valve has a housing part that is surrounded on its outer side by an extrusion coating. On the outer side of the housing part there is fashioned at least one recess into which the extrusion coating is at least partly introduced.

5 Claims, 1 Drawing Sheet

(56) References Cited

U.S. PATENT DOCUMENTS

| | | | | |
|---|---|---|---|---|
| 6,224,002 | B1 * | 5/2001 | Reiter | F02M 51/0653 239/533.12 |
| 6,382,187 | B1 | 5/2002 | Scollard et al. | |
| 2006/0137659 | A1 * | 6/2006 | Zdroik | F02M 69/042 123/470 |
| 2007/0114299 | A1 * | 5/2007 | Scheffel | F02M 51/0657 239/88 |
| 2008/0265065 | A1 * | 10/2008 | Lander | F02M 51/061 239/585.4 |
| 2010/0154746 | A1 * | 6/2010 | Fischer | F02M 61/14 123/456 |
| 2012/0031997 | A1 * | 2/2012 | Harvey | F02M 61/14 239/289 |
| 2014/0027545 | A1 * | 1/2014 | Graner | F02M 51/0682 239/585.1 |
| 2014/0203108 | A1 * | 7/2014 | Naumann | F02M 61/168 239/584 |
| 2014/0284402 | A1 * | 9/2014 | Scheffel | F02M 61/168 239/273 |
| 2015/0028137 | A1 * | 1/2015 | Kromer | F02M 63/0057 239/584 |
| 2015/0101572 | A1 * | 4/2015 | Serra | F02M 61/14 123/470 |
| 2016/0208729 | A1 * | 7/2016 | Sato | F02D 41/28 |
| 2018/0372046 | A1 * | 12/2018 | Oh | F02M 61/168 |

* cited by examiner

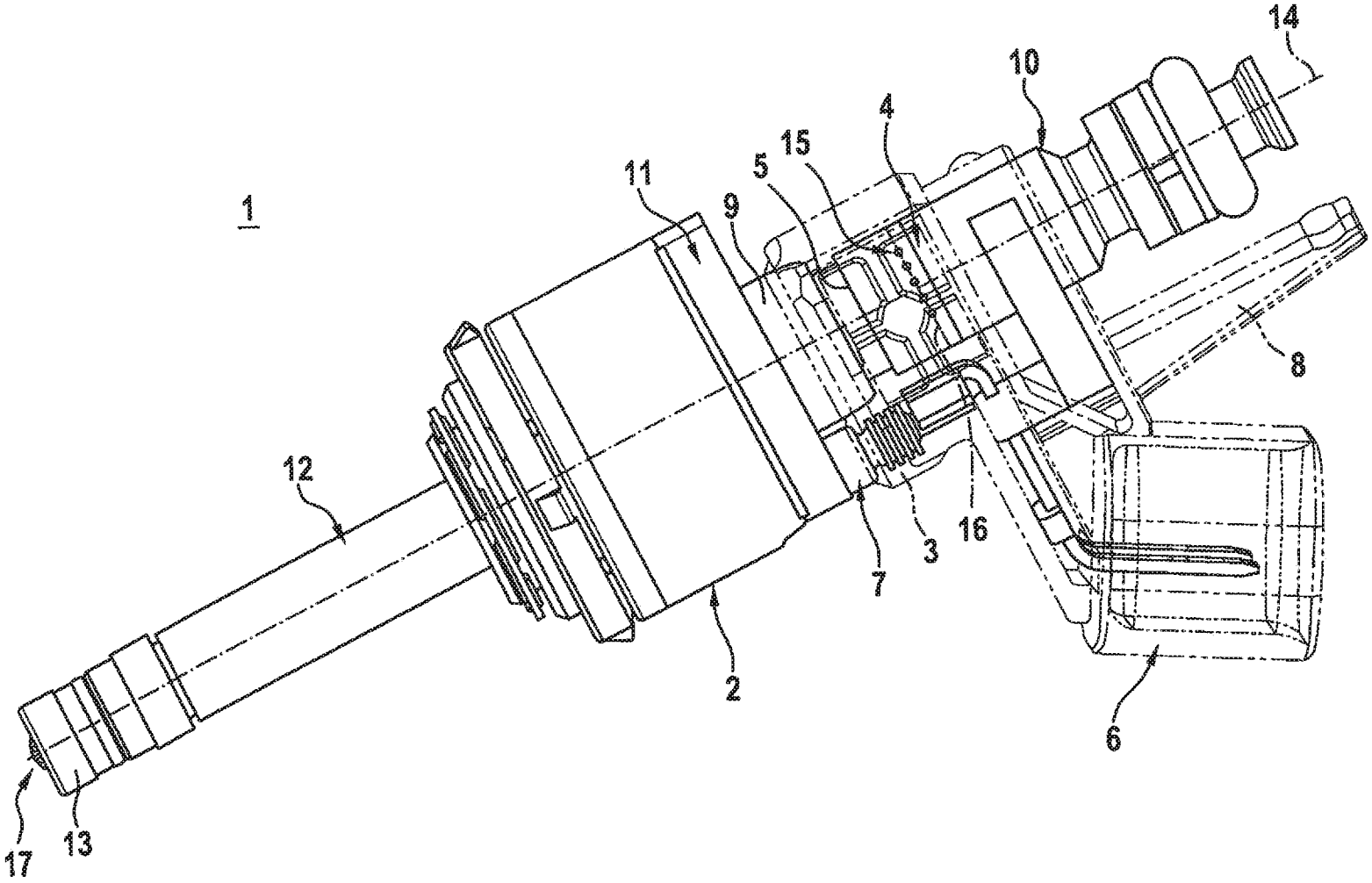
1
2
3
4
5
6
7
8
9
10
11
12
13
14
15
16
17

VALVE FOR METERING A FLUID

CROSS REFERENCE

The present application claims the benefit under 35 U.S.C. § 119 of German Patent Application No. DE 102015226452.1 filed on Dec. 22, 2015, which is expressly incorporated herein by reference in its entirety.

FIELD

The present invention relates to a valve for metering a fluid, in particular a fuel injection valve for internal combustion engines. Specifically, the present invention relates to the area of injectors for fuel injection systems of motor vehicles, in which preferably a direct injection of fuel into combustion chambers of an internal combustion engine takes place.

BACKGROUND INFORMATION

German Patent Application No. DE 199 50 761 A1 describes a fuel injection valve for fuel injection systems of internal combustion engines. The conventional fuel injection valve has a tubular valve seat bearer that can be introduced into a receptacle bore of a cylinder head of an internal combustion engine and is sealed against a receptacle bore of the cylinder head by a seal.

SUMMARY

The valve according to the present invention may have the advantage that an improved realization and functioning are enabled. Moreover, a desired installation position of the valve in a receptacle bore of a cylinder head or the like and a rotational securing during operation can be realized in an improved manner.

Advantageous developments of the valve in accordance with the present invention are described herein.

The valve is installed in a suitable manner. Here, a valve housing can be situated at least partly in a receptacle bore made for example in a cylinder head. At least a housing part of the valve housing is surrounded at its outer side at least partly by an extrusion coating. On the extrusion coating, for example an electrical terminal can be realized, and the extrusion coating can ensure a protection of electrical lines that are led for example to a coil. In order in particular to specify a rotational position of the valve relative to the receptacle bore, at the extrusion coating a suitable geometry can be realized that enables this. The rotational fixing realized via the extrusion coating can here be realized relative to the receptacle bore or to the cylinder head, or to some other component. However, this presupposes that the extrusion coating is fixedly connected to the valve housing, and remains connected during operation.

A precondition for this is however that a positive-fit connection is ensured between the valve housing and the extrusion coating. If the valve housing is made up, at least in the area of the extrusion coating, only of rotationally symmetrical housing parts, such as rotated tubes, then the problem results that during operation, in particular after some changes of temperature, a micro-gap arises between the extrusion coating and the valve housing. During installation, or during operation, such a micro-gap can for example cause a possibly limited rotation of the injection coating relative to the valve housing. A possible flattening of housing parts on their outer side has the disadvantage of increasing the production costs. Another possible measure, which uses an additional part such as a clamping disc, also results in higher production costs.

A possible advantage of a rotational fixing is an improved exhaust gas composition. For example, through a defined distribution of fuel in the combustion chamber, a wetting of surfaces is avoided, reducing the development of soot. This is particularly relevant for the reduction of a cylinder capacity, because here the injection pattern of the valve has to be adapted as well as possible to the respective engine geometry and the flow conditions in the combustion chamber.

An embodiment according to the present invention may have the advantage that the receptacle can be easily fashioned on the external side of the housing part. A bore or a hole can be made in the housing part, for example using a laser. Preferably, one or more holes are bored by laser in the context of laser welding during the joining of housing parts of the valve housing. In a modified embodiment, it is also possible for one or more receptacles to form a structure on the outer side of the housing part. Such a structure can also be burned into the outer side of the housing part using a laser. This can also take place in the context of a joining of housing parts of the valve housing. However, it is also possible for the receptacles to be made on the outer side of the housing part at a different time, in particular before the assembly of the valve housing. If a plurality of receptacles are fashioned on the outer side, in accordance with one example embodiment, then these can be made geometrically identical, or also made differently from one another. Another possibility is for the receptacles to have a knurled structure on the outer side of the housing part.

In accordance with the present invention, laser welding a relative rotation of the laser about a longitudinal axis of the valve housing can be realized, enabled by moving the laser or by rotating the valve housing about its longitudinal axis. This relative movement, which is realized, can then be correspondingly used to form the receptacles on the outer side of the housing part. This results in a simplification of the process.

The development according to a refinement of other example embodiment of the present invention enable a low-cost formation of the valve housing from the housing parts. In this way, there results a reduced outlay for the production of the housing parts of the valve housing, because for example flattened parts and the like can be omitted. In particular, here the housing parts can be made tubular.

The development according to another refinement of the present invention may have the advantage that the rotational fixing can be realized independent of the realization of the housing parts of the valve housing. This also enables a low-cost adaptation to the respective case of application. In particular, the rotational fixing here can interact with the body on which the receptacle bore is fashioned, or some other component, in particular a rail, without requiring adaptations of the valve housing for this purpose. A development according to another refinement of the present invention enables a particularly low-cost realization of the rotational fixing.

A valve housing in accordance with an example embodiment of the present invention can have one or more housing parts that are surrounded completely or partly by the extrusion coating. These housing parts are here advantageously based on a rotationally symmetrical basic shape in which the one or more recesses are made. However, this does not exclude that components or other housing parts are also provided on the valve housing that in themselves are not made rotationally symmetrical, if this is useful in the particular case of application. In addition, threads, used for example to screw together the valve housing, can also be provided on the rotationally symmetrical basic shape.

BRIEF DESCRIPTION OF THE DRAWING

Preferred exemplary embodiments of the present invention are explained in more detail below, with reference to the FIGURE.

FIG. 1 shows a valve in a schematic representation, corresponding to an exemplary embodiment of the present invention.

DETAILED DESCRIPTION OF EXAMPLE EMBODIMENTS

FIG. 1 shows a valve 1 for metering a fluid. Valve 1 is preferably used for metering a fuel, in particular gasoline or a fuel containing gasoline. Here, valve 1 can be fashioned as high-pressure injection valve 1, in particular as high-pressure fuel injection valve 1.

Valve 1 has a valve housing 2 and an extrusion coating 3. Extrusion coating 3 here surrounds an outer side 4 of a housing part 5 of valve housing 2. On extrusion coating 3 there is made a terminal 6 for a solenoid 7 and a rotational fixing 8. The rotational fixing 8 is fashioned as a part of extrusion coating 3 in this exemplary embodiment. In a modified embodiment, rotational fixing 8 can also be formed completely or partly from an additional element inserted into extrusion coating 3. In this way, the rotational fixing is joined to extrusion coating 3 on housing part 5.

In this exemplary embodiment, extrusion coating 3 also partly surrounds an inner pole 9 and a connecting sleeve 10 that form further housing parts 9, 10 of valve housing 2, and are integrated into valve housing 2. Solenoid 7, surrounded at least partly by extrusion coating 3, can have, from the point of view of assembly, a joining gap to a cover 11. For this reason, if no further measures were provided, extrusion coating 3 with solenoid 7 would also be able to rotate at least by a few degrees.

Valve housing 2 moreover has a nozzle body 12 on which valve seat body 13 is mounted. As a rule, at least nozzle body 12 is inserted into a suitable receptacle bore, valve seat body 13 being oriented towards a chamber, in particular a combustion chamber.

In particular the outer side 4 of housing part 5 is based on a rotationally symmetrical basic shape, in particular a basic shape in the form of a cylindrical jacket, which is rotationally symmetrical, or cylindrically jacket-shaped, relative to a longitudinal axis 14 of valve housing 2. In this basic shape of outer side 4, a plurality of recesses 15 are made. To simplify the representation, here only one recess 15 is depicted. In this exemplary embodiment, recesses 15 are situated equidistant from one another along a circumferential line 16 on outer side 4. In this way, recesses 15 are distributed uniformly around the circumference on outer side 15.

For example using a laser, which can also be used for a laser welding of valve housing 2, a laser boring of recesses 15 can take place along circumferential line 16. For this purpose, a relative movement between the laser and valve housing 2, relative to longitudinal axis 14, is carried out corresponding to a rotation about longitudinal axis 14. Here, housing part 5 can however also be provided with such recesses 15 before assembly.

Recesses 15 can be realized as bores. Such bores can be realized as through-bores 15 or also as blind-hole bores 15. Recesses 15 can also be realized as holes having a cross-section that is not necessarily circular, which can be fashioned as through-holes 15 or as blind holes 15.

In a modified embodiment, it is possible for only a single recess 15, in particular an individual bore 15 or an individual hole 15, to be fashioned on outer side 4 of housing part 5.

Depending on the design of valve 1, housing part 5 can also be a component of inner pole 9 or a component of connection sleeve 10. In addition, it is possible for a plurality of recesses 15 to be provided, and for these recesses 15 to be provided not only on a single component, but on two or more components 5, 9, 10. Specifically, recesses 15 can be provided alternately on two components 5, 9, 10.

During the extrusion coating of housing part 5, extrusion coating 3 is inserted at least partly into recesses 15, so that a positive-fit connection is formed between valve housing 2 and extrusion coating 3. In this way, a rotation of extrusion coating 3 relative to valve housing 2, about longitudinal axis 14, is prevented. This has the consequence that the position of the rotational fixing 8 relative to longitudinal axis 14 also determines the orientation of the valve seat body 13. Nozzle openings provided on a nozzle region 17 of valve seat body 13 can be reliably positioned in this way. A particular pattern of injection into the assigned chamber, in particular combustion chamber, can in this way be realized in a specified manner. Rotational fixing 8 enables a reliable positioning over the life span of valve 1.

In a modified embodiment, circumferential lines 16 differing from one another can also be provided, on which recesses 15 are situated. In a further modified embodiment, a plurality of recesses 15 can also be fashioned on outer side 4, offset along longitudinal axis 14. In addition, a plurality of recesses 15 can also be situated on outer side 4 in some other way.

The present invention is not limited to the described exemplary embodiments.

What is claimed is:

1. A valve for metering a fuel, comprising:

a housing having at least one housing part that is surrounded on its outer side by an extrusion coating, the housing part having a plurality of punctiform recesses on its outer side into which the extrusion coating is at least partly introduced;

wherein the valve is a fuel injection valve for an internal combustion engine, wherein the plurality of punctiform recesses is made as at least one of a bore in the housing part and a hole in the housing part, wherein the plurality of punctiform recesses are on the outer side of the housing part, wherein the plurality of punctiform recesses are situated on the outer side so as to be distributed around a circumference of the housing part, wherein the extrusion coating is inserted at least partly into the punctiform recesses, so that a positive-fit connection is formed between the housing, which is a valve housing, and the extrusion coating, so that a rotation of the extrusion coating relative to the valve housing, about a longitudinal axis along a length of the valve housing, is prevented, and so that a position of a rotational fixing relative to the longitudinal axis also determines an orientation of a valve seat body, wherein on the extrusion coating there is a terminal for a solenoid and the rotational fixing, which is formed at least partly from an element inserted into the extrusion coating, so that the rotational fixing is joined to the extrusion coating on the housing part, wherein the extrusion coating partly surrounds an inner pole and a connecting sleeve that form further housing parts of the valve housing, and are integrated into the valve housing, wherein the solenoid, surrounded at least partly by the extrusion coating, has a joining gap to a cover, so that the extrusion coating and the solenoid are rotatable relative to the cover during assembly, wherein the plurality of punctiform recesses are situated equidistant from one another along a circumferential line on the outer side, so that the plurality of punctiform recesses are distributed uniformly around the circumference on the outer side, and wherein the rotational fixing as recited is separate from the terminal and has a longitudinal axis which is parallel to the longitudinal axis along a length of the valve housing.

2. The valve as recited in claim 1, wherein the outer side of the housing part is based on a rotationally symmetrical basic shape in which the plurality of punctiform recesses is made.

3. The valve as recited in claim 1, wherein the outer side of the housing part is based on a cylindrical jacket-shaped basic shape in which the plurality of punctiform recesses is made.

4. The valve as recited in claim 1, wherein the rotational fixing with the extrusion coating is joined onto the housing part.

5. The valve as recited in claim 1, wherein the valve housing, including the housing part, and an outer side of the valve housing, including the outer side of the housing part, is based, at least in a region of the extrusion coating, on a rotationally symmetrical basic shape, the plurality of punctiform recesses being in the outer side of the housing part.

* * * * *